US011148765B2

(12) United States Patent
Pieschel et al.

(10) Patent No.: US 11,148,765 B2
(45) Date of Patent: Oct. 19, 2021

(54) INFLATABLE PLATFORM

(71) Applicants: Frank Pieschel, Apple Valley, MN (US); Francois Gagnon, Bangkok (TH); Eric Gagnon, Vancouver (CA); Chia Hua Lin, Bangkok (TH); Nicholas Pieschel, South Dennis, MA (US)

(72) Inventors: Frank Pieschel, Apple Valley, MN (US); Francois Gagnon, Bangkok (TH); Eric Gagnon, Vancouver (CA); Chia Hua Lin, Bangkok (TH); Nicholas Pieschel, South Dennis, MA (US)

( * ) Notice: Subject to any disclaimer, the term of this patent is extended or adjusted under 35 U.S.C. 154(b) by 95 days.

(21) Appl. No.: 16/781,900

(22) Filed: Feb. 4, 2020

(65) Prior Publication Data

US 2020/0247508 A1 Aug. 6, 2020

Related U.S. Application Data

(60) Provisional application No. 62/800,855, filed on Feb. 4, 2019.

(51) Int. Cl.
*B63B 34/52* (2020.01)
*B63B 34/54* (2020.01)

(52) U.S. Cl.
CPC ..... *B63B 34/52* (2020.02); *B63B 34/54* (2020.02)

(58) Field of Classification Search
CPC ..... B63B 34/00; B63B 34/40; B63B 34/50; B63B 34/52; B63B 34/54; B63B 35/00; B63B 35/58; B63B 35/607; B63B 35/613
USPC ..... 441/35, 40, 43, 47, 50, 65, 66, 80, 87, 441/88, 90, 125–132
See application file for complete search history.

(56) References Cited

U.S. PATENT DOCUMENTS 3,021,536 A * 2/1962 Haggerty ..... B63B 7/08 441/40
4,747,797 A * 5/1988 Hindle ..... B63C 9/04 441/38
5,219,307 A * 6/1993 Morrison ..... B63B 34/50 441/38
D481,437 S * 10/2003 Peterson ..... A47G 9/1027 D21/803
D483,088 S * 12/2003 Zheng ..... D21/803
D486,877 S * 2/2004 Peterson ..... D21/809
D487,130 S * 2/2004 Peterson ..... D21/809
7,818,842 B2 * 10/2010 Marciano ..... A47G 9/1027 5/694
7,918,698 B2 * 4/2011 Schloegel ..... B63C 9/04 441/35
8,702,461 B1 4/2014 d'Offay
9,126,655 B2 9/2015 Swan
(Continued)

*Primary Examiner* — Daniel V Venne

(57) ABSTRACT

An inflatable platform that is utilized on the ocean or other bodies of water for relaxation, entertainment, or other recreational purposes includes two floating bodies. The larger floating body has a recess with a mesh panel so the user may access water filtered by the mesh panel while relaxing on the larger floating body. The user may place the smaller floating body next to the larger floating body to create more space for another user or may put the smaller floating body into the recess and use the present invention as a swim platform, tanning deck, or other recreational purpose.

9 Claims, 6 Drawing Sheets

(56) References Cited

U.S. PATENT DOCUMENTS

| | | | |
|---|---|---|---|
| 9,486,083 | B2 | 11/2016 | Berenson et al. |
| 2010/0111613 | A1 | 5/2010 | Rista |

* cited by examiner

INFLATABLE PLATFORM

The current application claims a priority to the U.S. Provisional Patent application Ser. No. 62/800,855 filed on Feb. 4, 2019.

FIELD OF THE INVENTION

The present invention generally relates to a floating device used on any body of water. More specifically, the present invention is an inflatable platform with two floating bodies. Those two floating bodies can either float by themselves, or joint together to save storage space.

BACKGROUND OF THE INVENTION

Floatation devices are popular items for any recreational activity near larger body of water. However, issues arise with available flotation devices on the market. They either are not ridged because they are not made from drop stitch material. If the floating device is made from drop stitch material it is only a single function item. It cannot be used as a deck, lounge and deck and lounge.

The present invention provides solutions to all issue mentioned above by providing an inflatable platform that comprises two floating bodies with multiple configurations. The user may join both floating bodies together as a single swim platform or deck, which accommodates multiple users and provides one firm surface for all kinds of recreational activities. The user can also take the smaller floating body out and use as a floating lounge, where water flow through the mesh of the larger floating body so the user can float and relax in the water and be supported by the mesh bottom. The user also has the option to attach the smaller floating body, which is generally removed to make the product a lounge to use as a separate deck surface.

DETAIL DESCRIPTIONS OF THE INVENTION

Figure 1:
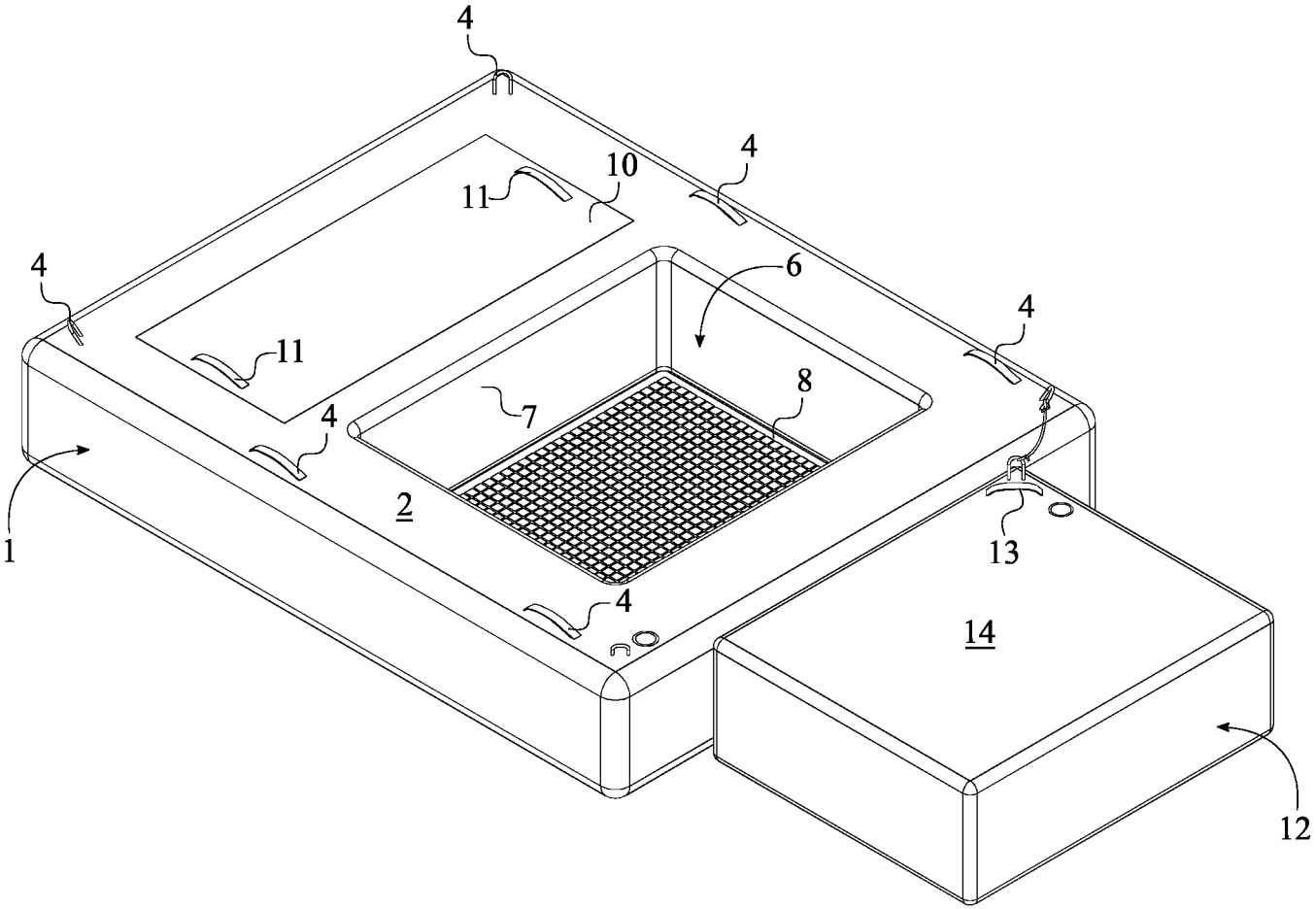
FIG. 1 is a perspective view of the present invention.

All illustrations of the drawings are for the purpose of describing selected versions of the present invention and are not intended to limit the scope of the present invention.

The present invention is an inflatable platform with separable parts. The top side of the present invention is made of drop stitch material. The user may use the present invention as one or more floating objects on the ocean or other bodies of water for relaxation, entertainment, or other recreational purposes. In reference to FIGS. 1 and 2, the present invention is an inflatable platform that comprises a primary floating body 1, a recess 6, a mesh panel 8, and a secondary floating body 12. The primary floating body 1 is configured as the base structure to hold every component of the present invention. The user may place some light furniture or other objects on the primary floating body 1 without worrying about getting wet. The primary floating body 1 comprises a top side 2 and a bottom side 3. The top side 2 is configured to provide a surface for the user to rest himself/herself while the present invention is floating on a certain body of water. The user may also place other items on the top side 2, such as light furniture to improve his experience. The bottom side 3 is configured to hold the mesh panel 8 and provide direct contact with water. The recess 6 traverses through the primary floating body 1. The recess 6 is configured to allow the user to access the water that flows through the mesh panel 8 while the user is positioned adjacent the top side 2. The mesh panel 8 is perimetrically connected to the bottom side 3 around the recess 6. The mesh panel 8 is configured as a filter to prevent unwanted objects from traversing through the primary floating body 1 via the recess 6. Since the user may want certain access of the water that moves through the mesh panel 8 to the recess 6, but other objects, such as fish, marine animals, or sharp objects, may cause danger to the user if not filtered out by the mesh panel 8. The mesh panel 8 can also be used as a sitting area, which allows the user to sit on the mesh panel 8 while enjoying the water flow through the mesh panel 8. The secondary floating body 12 is configured to provide additional space and let more than one user share the present invention on a certain body of water. The secondary floating body 12 can be used as a deck when the lounge is being used. The secondary floating body 12 is adjacently positioned to the primary floating body 1, wherein the primary floating body 1 and the secondary floating body 12 can be configured between a compact configuration which is a single floating deck and an extended configuration which is two separate floating decks.

In the illustrated embodiment, the primary floating body 1 and the secondary floating body 12 are of rectangular shape; however, it should be understood that the first body can also take other shapes, including but not limited to triangle, circle, square, polygon and any irregular shapes as desired.

The primary floating body 1 and the secondary floating body 12 each comprises an air valve through which the primary floating body 1 and the secondary floating body 12 are inflated by a blower device which can be electrical or mechanical. The air valve is preferably a one-way air valve to prevent blowback during inflation, and to make it easier to close the air valve with a valve cap.

Figure 2:
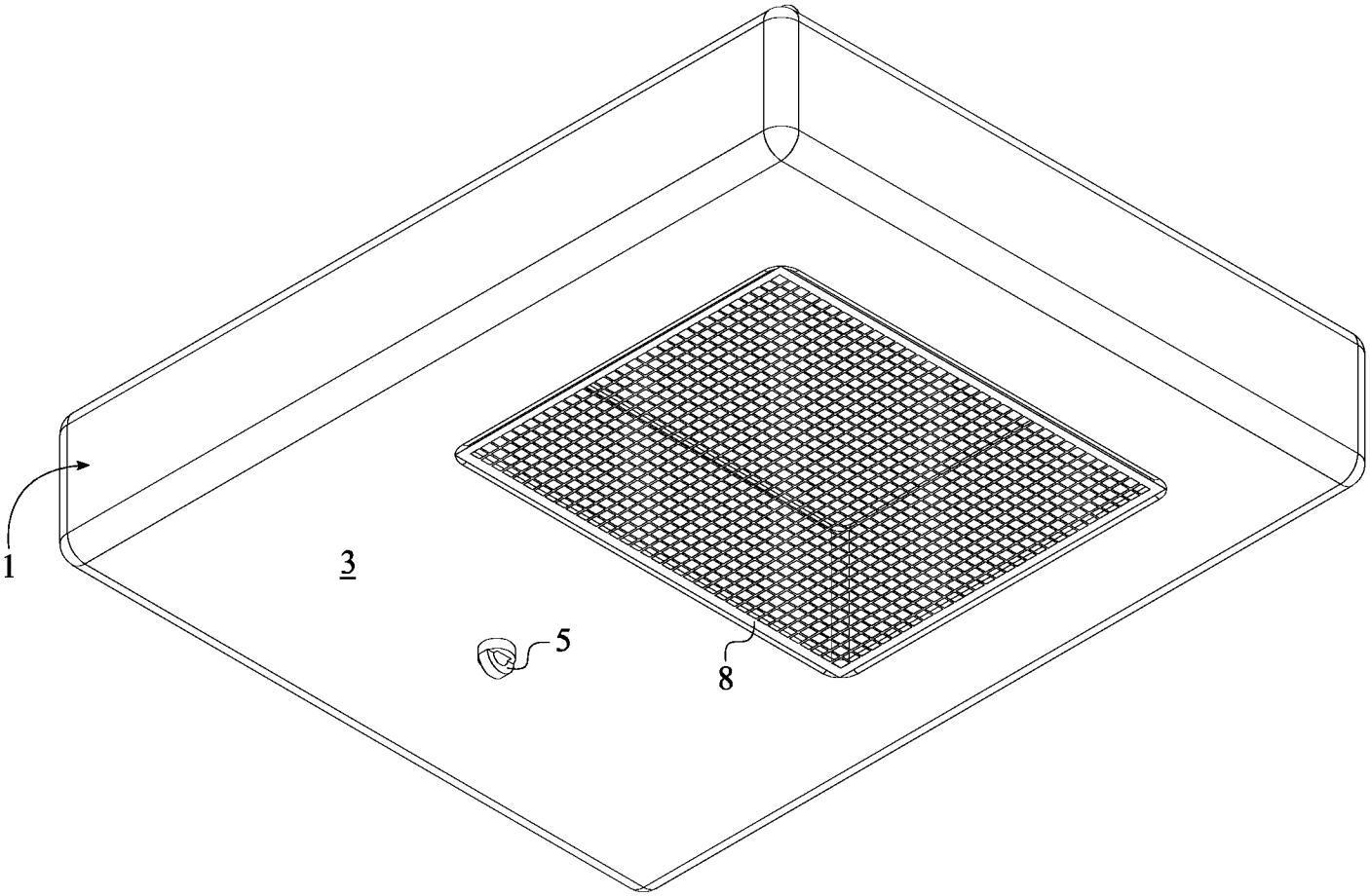
FIG. 2 is a bottom perspective view of the primary floating body.

In reference to FIGS. 1 and 2, the primary floating body 1 comprises a plurality of upper handles 4. The plurality of upper handles 4 is perimetrically distributed on the top side 2 and preferably a plurality of D-rings. The plurality of upper handles 4 is adjacently mounted on the top side 2. The user may grab one or more upper handles 4 to move the primary floating body 1 to different locations. The user may also tie a rope or a string to one or more upper handles 4 to link the present invention to a stationary object and prevents the primary floating body 1 from floating away. When the user is placing the secondary floating body 12 next to the primary floating body 1, the user may tie a rope on one or more upper handle 4 on the primary floating body 1 to link the primary floating body 1 to the secondary floating body 12. The primary floating body 1 comprises at least one lower handle 4. The at least one lower handle 4 is adjacently mounted onto the bottom side 3. The user may grab the at least one lower handle 4 to move the primary floating body 1 to different locations. The user may also tie a rope to the at least one lower handle 4 to link the present invention to a stationary object and prevents the primary floating body 1 from floating away. The user may also tie a rope on the at least one lower handle 4 to link the primary floating body 1 to the secondary floating body 12. It should be noted that the number of and the locations of the plurality of upper handles 4 and the at least one lower handle 4 can be chosen by those skilled in the art in accordance with actual needs and may be different from those illustrated in the drawings.

Figure 4:
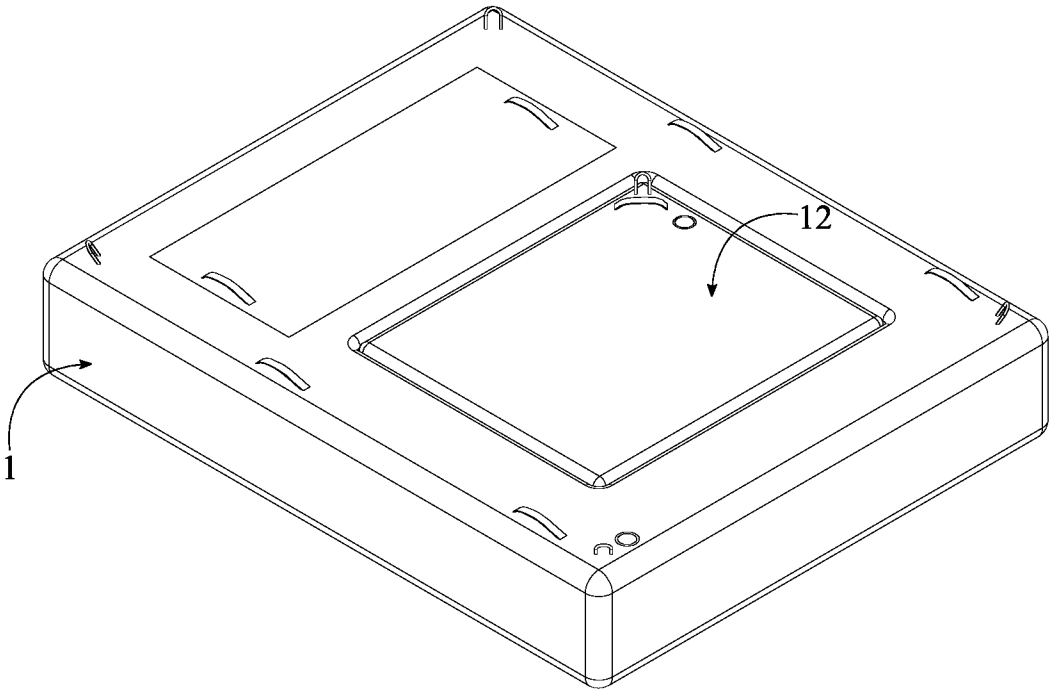
FIG. 4 is a perspective view of the secondary floating combined into the primary floating body.

In reference to FIGS. 1 and 4, the recess 6 comprises a lateral wall 7. The mesh panel 8 is perimetrically connected around the lateral wall 7. The user may access the water that flows through the mesh panel 8 into recess 6. The recess 6 is also large enough to receive the secondary floating body 12 when the user wants to pack and store the present invention. In other words, the user may combine the secondary floating body 12 to the primary floating body 1 by introducing a portion to the entire secondary floating body 12 into the recess 6. This configuration greatly reduces the space required for storage. Moreover, since the present invention comprises two floating bodies, the user may inflate one or both floating bodies prior to usage and may deflate them for storage.

In reference to FIG. 1, the primary floating body 1 comprises a drop stitch deck panel 10. The drop stitch deck panel 10 is connected to the top side 2. The drop stitch deck panel 10 is positioned adjacent to the recess 6. The drop stitch panel is configured to provide a surface on the top side 2 for the user to perform certain activities with the feel of a firm surface. Since surface made from drop stitch structure is a common commodity in deck or lounge by providing both rigidity and stability, it is the best structure for the top side 2 to ensure full enjoyment for the user. By positioning the drop stitch deck panel 10 adjacent to the recess 6, the user may easily access water filtered by the mesh panel 8 while resting on the drop stitch deck panel 10. The drop stitch deck panel 10 comprises a plurality of deck handles 11. The user may grab the plurality of deck handles 11 to stabilize himself when climbing onto the drop stitch deck panel 10. The plurality of deck handles 11 is adjacently connected onto the drop stitch deck panel 10. The user may grab and hold onto the plurality of deck handles 11 when the user needs to change position or want to move the primary floating body 1 to other location.

Figure 3:
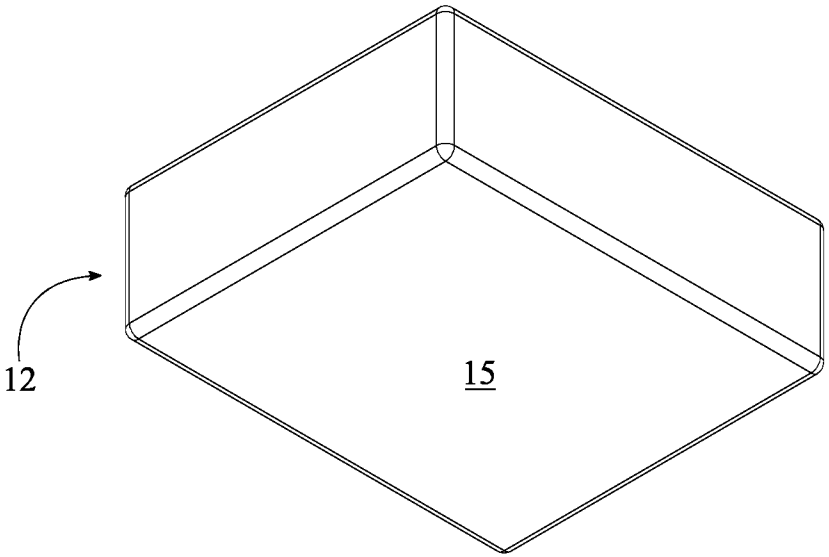
FIG. 3 is a bottom perspective view of the secondary floating body.

In reference to FIGS. 1 and 3, the secondary floating body 12 comprises a deck surface 14, a bottom surface 15, and at least one handle 13. The at least one handle 13 is adjacently connected onto the deck surface 14. When the secondary floating body 12 is floating on the water, the bottom surface 15 contacts the water, and the deck surface 14 is positioned on the opposite side of the bottom surface 15. The deck surface 14 is configured to provide extra space so more than one user can use the present invention together. The user may grab the at least one handle 13 and move the secondary floating body 12 to other locations or tie a rope on one or more handle to link the secondary floating body 12 to the primary floating body 1 or to other objects, such as anchor, boat, or shore.

Figure 5:
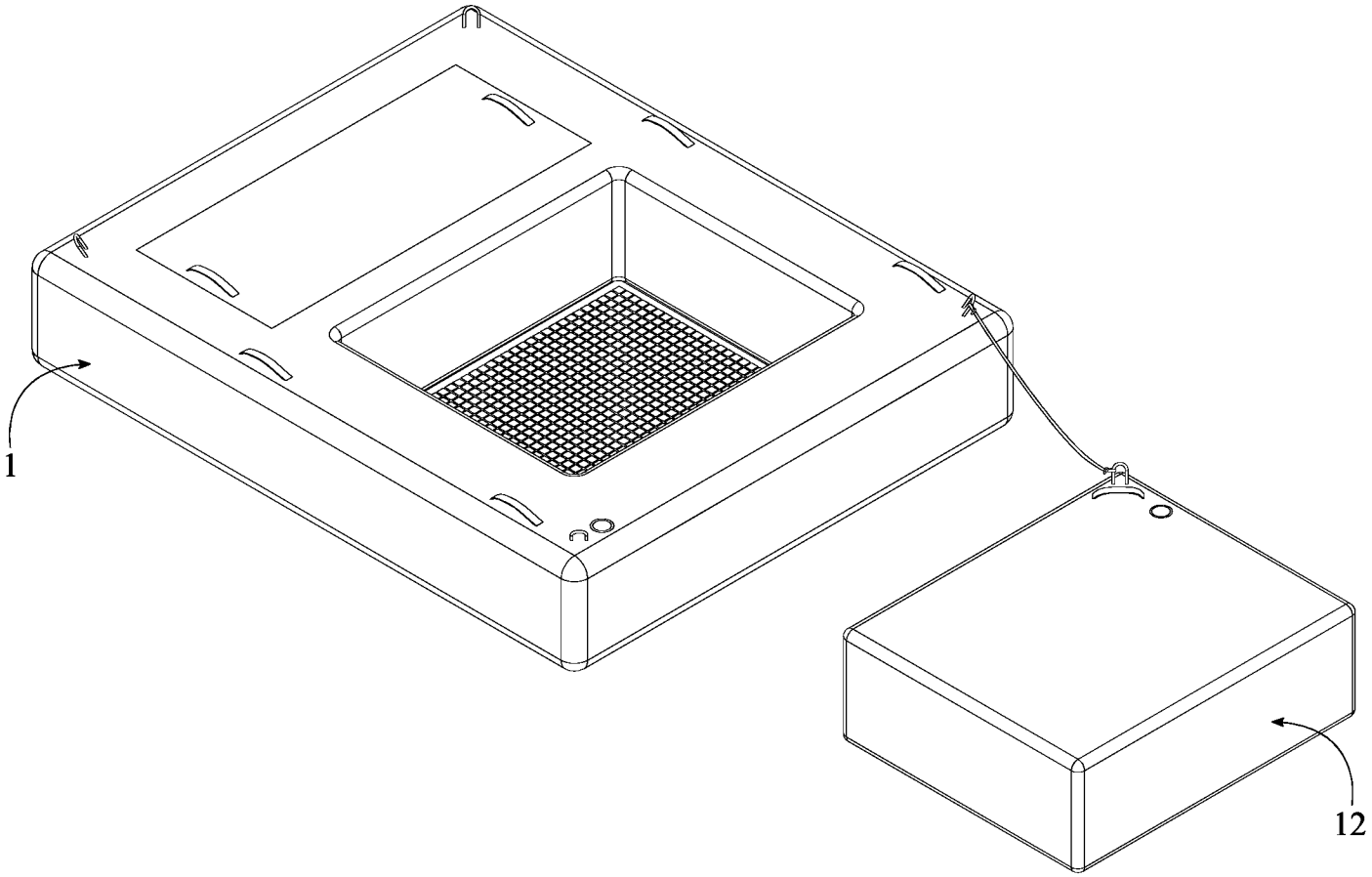
FIG. 5 is a perspective view of the present invention, with the primary floating body separate from the secondary floating body, showing the fastener.
Figure 6:
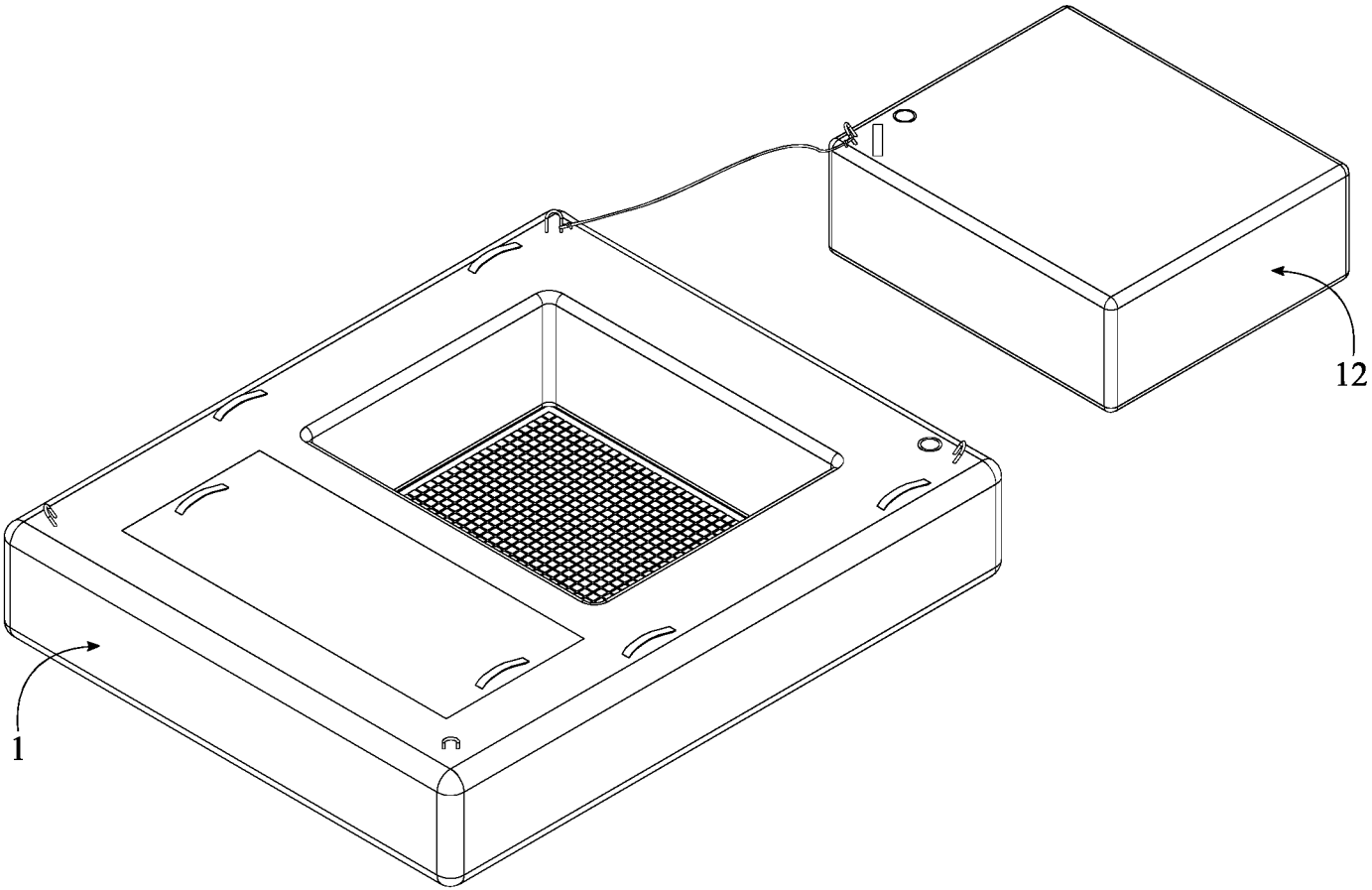
FIG. 6 is another perspective view of the present invention, with the primary floating body separate from the secondary floating body, showing the fastener.

In reference to FIGS. 5 and 6, the present invention comprises the compact configuration and the extended configuration. In the compact configuration, the secondary floating body 12 is removably engaged within the recess 6, and the secondary floating body 12 is positioned on top of the mesh panel 8. This configuration is achieved by introducing the secondary floating body 12 into the recess 6 of the primary floating body 1 for storage purpose or for single user. The present invention comprises a fastener, which is configured to attach the secondary floating body 12 to the primary floating body 1 in the extended configuration. In the extended configuration, the secondary floating body 12 is positioned laterally to the primary floating body 1. The secondary floating body 12 is externally tethered to the primary floating body 1 through the fastener that is preferably a rope or a string. This configuration is useful when more than one user is using the present invention together, or when the user wants to put more items and requires more space than the primary floating body 1 can provides.

Although the invention has been explained in relation to its preferred embodiment, it is to be understood that many other possible modifications and variations can be made without departing from the spirit and scope of the invention.

What is claimed is:

1. An inflatable platform comprises:
- a primary floating body;
- a recess;
- a mesh panel;
- a secondary floating body;
- the primary floating body comprising a top side and a bottom side;
- the recess traversing through the primary floating body;
- the mesh panel being perimetrically connected to the bottom side around the recess; and
- the secondary floating body being adjacently positioned to the primary floating body, wherein the primary floating body and the secondary floating body can be configured between a compact configuration which is a single floating deck and an extended configuration which is two separate floating decks.

2. The inflatable platform as claimed in claim 1 comprises:
- a plurality of upper handles;
- the plurality of upper handles being perimetrically distributed on the top side; and
- the plurality of upper handles being adjacently mounted on the top side.

3. The inflatable platform as claimed in claim 1 comprises:
- at least one lower handle; and
- the at least one lower handle being adjacently mounted onto the bottom side.

4. The inflatable platform as claimed in claim 1 comprises:
- the recess comprising a lateral wall; and
- the mesh panel being perimetrically connected around the lateral wall.

5. The inflatable platform as claimed in claim 1 comprises:
- a drop stitch deck panel;
- the drop stitch deck panel being connected onto the top side; and
- the drop stitch deck panel being positioned adjacent of the recess.

6. The inflatable platform as claimed in claim 5 comprises:
- a plurality of deck handles; and
- the plurality of deck handles being adjacently connected onto the drop stitch deck panel.

7. The inflatable platform as claimed in claim 1 comprises:
- the secondary floating body comprising a deck surface, a bottom surface, and at least one handle; and
- the at least one handle being adjacently connected onto the deck surface.

8. The inflatable platform as claimed in claim 1 comprises:

the compact configuration;

the second floating body being removably engaged within the recess; and the second floating body being positioned atop the mesh panel.

9. The inflatable platform as claimed in claim 1 comprises:

the extended configuration;

the second floating body being positioned lateral to the primary floating body; and the second floating body being externally tethered to the primary floating body.

* * * * *